United States Patent [19]

Oku

[11] Patent Number: 4,981,376

[45] Date of Patent: Jan. 1, 1991

[54] SINGLE MOTOR RIBBON LIFT AND DRIVE MECHANISM FOR PRINTING APPARATUS

[75] Inventor: Nobuaki Oku, Nagoya, Japan

[73] Assignee: Brother Kogyo Kabushiki Kaisha, Nagoya, Japan

[21] Appl. No.: 517,540

[22] Filed: Apr. 26, 1990

Related U.S. Application Data

[63] Continuation of Ser. No. 196,014, May 19, 1988, abandoned.

[30] Foreign Application Priority Data

May 19, 1987 [JP] Japan ..... 62-123392

[51] Int. Cl.[5] ..... B66C 5/04

[52] U.S. Cl. ..... 400/212; 400/223; 400/225; 400/185

[58] Field of Search ..... 400/212, 223, 225, 208, 400/240, 240.1, 240.4, 185, 186, 187

[56] References Cited

U.S. PATENT DOCUMENTS

| | | | |
|---|---|---|---|
| 4,329,072 | 5/1982 | Kacmarcik | 400/212 X |
| 4,563,100 | 1/1986 | Hamamichi | 400/212 X |
| 4,609,297 | 9/1986 | Hubner et al. | 400/212 X |
| 4,611,938 | 9/1986 | Rettke et al. | 400/212 |
| 4,741,638 | 5/1988 | Okabayashi et al. | 400/212 X |
| 4,787,763 | 11/1988 | Kondo | 400/212 X |
| 4,798,489 | 1/1989 | Shiota | 400/212 X |

FOREIGN PATENT DOCUMENTS

| | | | |
|---|---|---|---|
| 0083878 | 5/1985 | Japan | 400/212 |
| 0078685 | 4/1986 | Japan | 400/212 |
| 0205177 | 9/1986 | Japan | 400/212 |
| 0215081 | 9/1986 | Japan | 400/212 |
| 0270184 | 11/1986 | Japan | 400/212 |
| 0256683 | 11/1987 | Japan | 400/212 |

OTHER PUBLICATIONS

IBM Technical Disclosure Bulletin, "Variable Lift and Feed Increment Ribbon/Correction Mechanism", Greenlief et al., vol. 26, No. 3B, Aug. 1983, pp. 1580–1582.

*Primary Examiner*—Eugene H. Eickholt

*Attorney, Agent, or Firm*—Kane, Dalsimer, Sullivan, Kurucz, Levy, Eisele and Richard

[57] ABSTRACT

A printing apparatus employing a print ribbon provided with at least two print zones divided in width direction thereof wherein the print zones are cyclically located opposedly to a print position on a platen.

A single drive power source is used to drive a ribbon holder rocking mechanism and a ribbon winding mechanism. The drive force of the drive power source to rock the ribbon holder is transmitted to the ribbon winding mechanism through a gear train. The gear train is arranged such that the drive force is transmitted therethrough only during a predetermined range of the stroke of the rocking motion of the ribbon holder.

The rocking motion of the ribbon holder is controlled to vary the amount thereof depending upon the width of characater or symbol to be printed so as to vary the winding volume of the ribbon.

12 Claims, 13 Drawing Sheets

SINGLE MOTOR RIBBON LIFT AND DRIVE MECHANISM FOR PRINTING APPARATUS

This is a continuation of co-pending application Ser. No. 196,014 filed on May 19, 1988 and now abandoned.

BACKGROUND OF THE INVENTION

This invention relates to a ribbon lift mechanism for a printing apparatus such as a typewriter and a printer.

It has been proposed to use a wide multi-zone print ribbon in a printing apparatus, as disclosed in Japanese Utility Model Application No. SHO62-27077 wherein a step motor is mounted on a carriage to lift each print zone of the ribbon to a print position. In this apparatus, the drive force of the step motor is transmitted also to a ribbon winding mechanism through engagement of an engaging pin with a grooved cam, to thereby perform lifting and winding the ribbon at the same time. This reduces the number of drive power sources required and therefore the cost taken for them to a minimum.

In the above printing apparatus, however, there has been one problem. That is, as the driving force of the stepping motor is transmitted to the ribbon winding mechanism through engagement of the pin with the grooved cam, it becomes necessary to drive the ribbon winding mechanism against the sliding resistance between the pin and the grooved cam. This results in need of a motor with a greater torque, and therefore increasing the costs therefor.

SUMMARY OF THE INVENTION

Accordingly, it is an principal object of this invention to provide a printing apparatus employing a wide multi-zone ribbon, which requires a smaller driving force to drive the ribbon winding mechanism to allow the use of a less expensive motor with a smaller torque.

Another object of this invention is to provide a printing apparatus capable of varying the ribbon feed volume in dependence on the size of a character or a symbol to be printed to avoid wasting the print ribbon.

According to one aspect of the invention, there is provided a printing apparatus employing a print ribbon mounted on a ribbon holder, said print ribbon being provided with at least two print zones divided in width direction thereof, said print zones being cyclically located opposedly to a print position on a platen, said printing apparatus comprising:

- a holder rocking mechanism for rocking said ribbon holder to cyclically locate said print zones opposedly to said print position;
- a drive power source for driving said holder rocking mechanism;
- a ribbon winding mechanism for winding a used section of the print ribbon; and
- an intermittent gear train for transmitting the driving force of said drive power source to said ribbon winding mechanism during a predetermined rocking motion of said ribbon holder.

With the above constructed printing apparatus, the ribbon holder is rocked up and down by means of the drive power source. With a certain stroke of rocking motion, the gear train is brought into rotation, which is transmitted to the ribbon winding mechanism to wind the used section of the print ribbon.

According to another aspect of the invention, there is provided the printing apparatus which further comprises:

- first setting means for setting a stroke of rocking motion of said ribbon holder in accordance with a ribbon winding volume depending upon a size of a character or symbol to be printed;
- discriminating means for discriminating one of the print zones to be used for next printing based upon the previously used print zone;
- second setting means for setting a stroke of rocking motion of said ribbon holder in accordance with the print zone discriminated by said discriminating means; and
- control means for driving said drive power source in accordance with the total amount of rocking motion strokes being set by said first and second setting means.

With a thus constructed printing apparatus, the rocking stroke of the ribbon holder is determined by the setting means in accordance with the ribbon's winding volume which depends on the size of the characters and symbols to be printed. The print zone used for printing is identified by the discriminating means so that the operation of the drive power source in a certain stroke is controlled by the control means in accordance with the rocking stroke of the holder and the discrimination result. With this controlled operation of the driving power source, the ribbon holder is rocked up and down, the rocking motion of the ribbon holder being transmitted to the ribbon winding mechanism by means of the power transmission mechanism for winding of the ribbon in accordance with the size of the characters and symbols to be printed.

According to still another aspect of the invention, there is provided the printing apparatus which further comprises:

- first discriminating means for discriminating one of the print zones to be used for next printing based upon the previously used print zone;
- first setting means for setting a stroke of rocking motion of said ribbon holder in accordance with the print zone discriminated by said discriminating means;
- second discriminating means for discriminating whether or not at least one large width character is printed in a previous cycle of printing with said print zones, said discrimination being executed only when the predetermined print zone is discriminated as the next print zone by said first discriminating means;
- second setting means for setting an additional stroke of rocking motion of said ribbon holder when the result of discrimination by said second discrimination is affirmative; and
- control means for driving said drive power source in accordance with the total amount of rocking motion strokes being set by said first and second setting means;
- with a thus constructed printing apparatus, the rocking stroke of the ribbon holder is enlarged only when at least one large width character is printed in a previous cycle of printing with the print zones.

DESCRIPTION OF THE ACCOMPANYING DRAWINGS

FIG. 1 a front perspective view of the typewriter embodying the invention;

DESCRIPTION OF THE EMBODIMENTS

Figure 1:
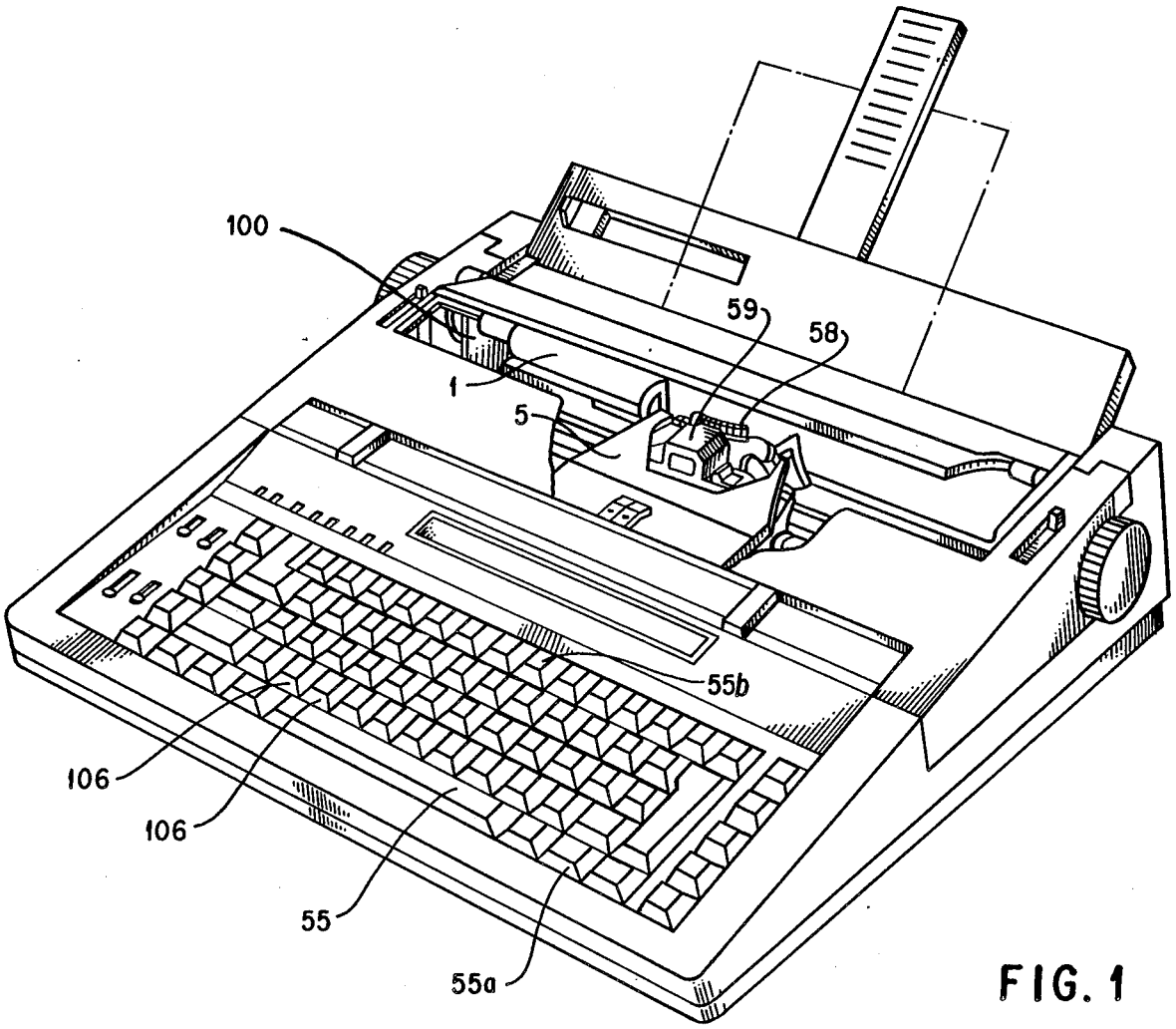

FIGS. 1 through 4 show a typewriter embodying the invention wherein a carriage 2 is movably mounted in front of a platen 1 carried by a machine frame 100, extending in parallel with the platen 1. On the carriage 2 supported is a ribbon holder 3 for pivotal movement about a pivot shaft 4 secured to the carriage 2. A ribbon cassette 5 located above the ribbon holder 3 accommodates a print ribbon 5*a*, whose width is divided into three print zones. The ribbon 5*a* is adapted to travel along the platen 1 with its part exposed to face the platen surface.

Figure 3:
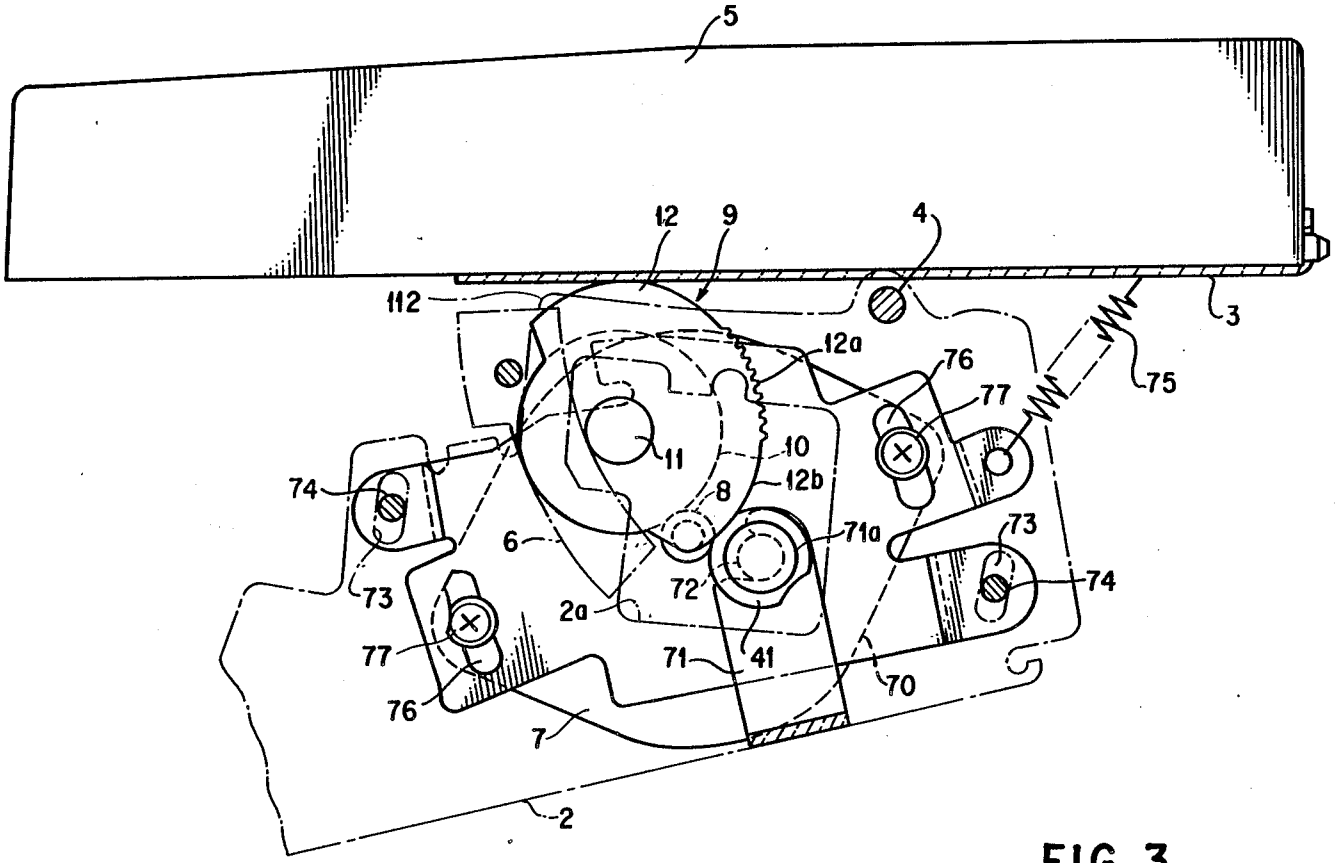
FIG. 3 is an elevation partly in section of a holder rocking mechanism.
Figure 4:
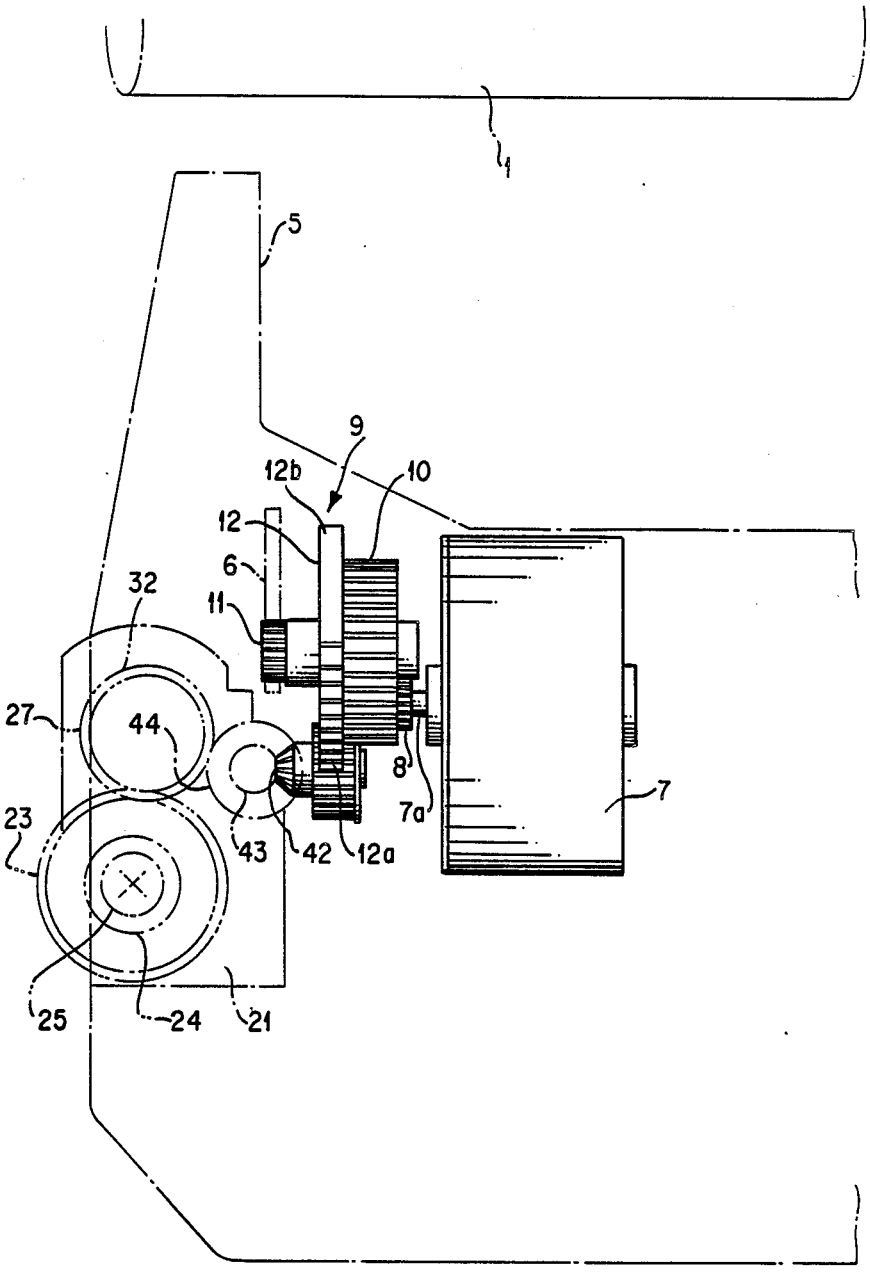
FIG. 4 is a partial plan view of FIG. 1.

A transmission gear 6 is at its upper end mounted on one side of the ribbon holder 3 and extended along an arc around the pivot shaft 4. Inside the side wall 102 of the carriage 2 mounted is a bracket 70 which is supported by a support member 71 projected from the bottom wall 104 of the carriage 2 at a location between the bracket 70 and the side wall 102 of the carriage 2. The support member 71 is formed with, as illustrated in FIG. 3, a bearing recess 71*a* which bears a pivot stud 72 projectedly mounted on the bracket 70. The side wall 102 of the carriage 2 is further provided with a pair of arc-shaped fitting grooves 73, 73 extending about the pivot stud 72. The pivotal movement of the bracket 70 with respect to the side wall 102 of the carriage 2 is regulated by a pair of screws 74, 74 threaded onto the bracket 70 through the fitting grooves 73, 73 for adjustable angular movement of the bracket 70 about the pivot stud 72. A tension spring 75 is bridged between the bracket 70 and the ribbon holder 3 to bias the bracket 70 to rotate about the pivot stud 72 in the counter-clockwise direction in FIG. 3.

A step motor 7 as a driving power source is mounted on one side of the bracket 70 by a pair of screws 77, 77 threaded onto the step motor 7 through a pair of arc-shaped fitting grooves 76, 76 formed on the bracket 70 extending about the pivot stud 72, as illustrated in FIG. 3 for adjustable angular movement of the step motor 7 about a drive gear 8 mounted on the output shaft 7*a* of the step motor 7. The drive gear 8 is housed in a cutaway 2*a* of the carriage 2. A rotary member 9 is pivotally carried on the bracket 70 at a location between the drive gear 8 and the transmission gear 6. The rotary member 9 has integrally formed thereon a large-diameter intermediate gear 10 in mesh with the drive gear 8, a small-diameter intermediate gear 11 in mesh with the drive gear 6, and an intermittent gear 12 having on its circumference a threaded section 12*a* and a plain (non-threaded) section 12*b* which has the same radius as that of the pitch circle of the threaded section 12*a*.

Figure 7:
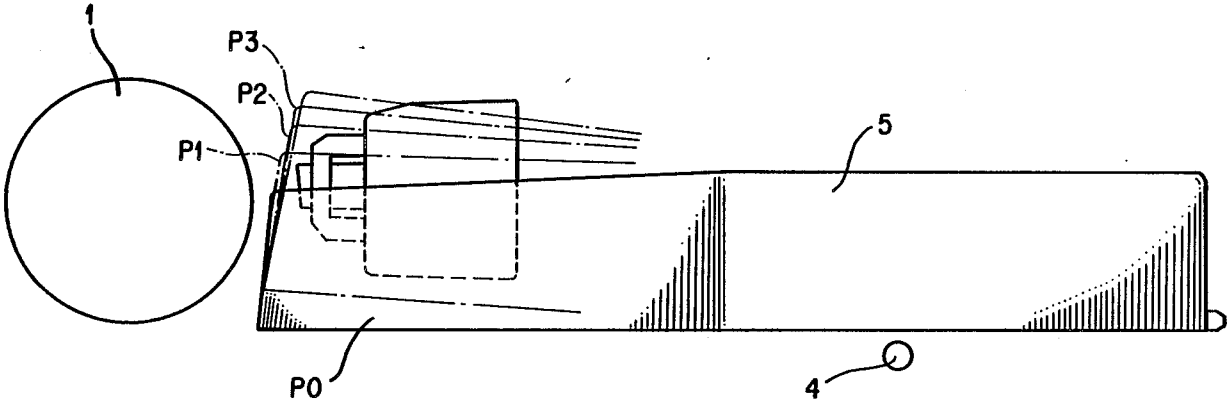
FIG. 7 is an explanatory view for operation of the holder rocking mechanism.

The ribbon holder 3 is rocked up and down in response to forward and backward rotation of the step motor 7 which is transmitted to the transmission gear 6 by way of the drive gear 8, the large-diameter intermediate gear 10, and the small-diameter intermediate gear 11. The ribbon holder 3 is adapted to take three different positions shown in FIG. 7 in dependence on rotational stroke of the step motor 7, i.e., the home position P0, the first lift position P1, the second lift position P2 and the third lift position P3. In any of three lift positions P1 to P3, the print ribbon 5*a* is placed across the print position on the platen 1.

In the meantime, when the screws 74, 74 are loosened, the bracket 70 is urged to rotate in the counter-clockwise direction in FIG. 3 about the pivot stud 72 by the biasing force of the tension spring 75, so that the small-diameter intermediate gear 11 is loaded to firmly mesh with the transmission gear 6. As a result, the backlash between the intermediate gear 11 and the transmission gear 6 is adjusted, and the bracket 70 is then secured to the carriage 2 by tightening the screws 74, 74.

Explanation is now provided for a ribbon winding mechanism 114. As illustrated in FIGS. 2 and 4 through 6, a bracket 21 is mounted on one side of the carriage 2 and rotatably supports thereon a ribbon take-up unit 26 which consists of a carrier cylinder 22, a transmission gear 23, a joint element 24, and a spool connection shaft 25. The carrier cylinder 22 is rotatably supported on the bracket 21, while the transmission gear 23 is fixedly attached to the outer circumference of the carrier cylinder 22 by means of the joint element 24. Also, the spool connection shaft 25 is tiltably retained in the hollow of the carrier cylinder 22 by means of the joint element 24 and a spring 22*a*.

The bracket 21 further includes a rotation transmitting element 29 rotatably supported thereon, which is at its top provided with an intermediate gear 27 in mesh with the transmission gear 23 and at its bottom with a ratchet wheel 28. The rotation transmitting element 29 is held against rotation by means of a spring 30 mounted on the bracket 21 and by its engagement with the intermediate gear 27. The stem 29*a* of the rotation transmitting element 29 also carries thereon an intermediate gear 32 and a disc 33 for integral rotation therewith. The disc 33 is at its bottom provided with a ratchet pawl 34 rotatable about its base end, the leading end of which is engageable with the ratchet wheel 28. The ratchet pawl 34 is biased to come into mesh with the ratchet wheel 28 by a spring 35.

Figure 6:
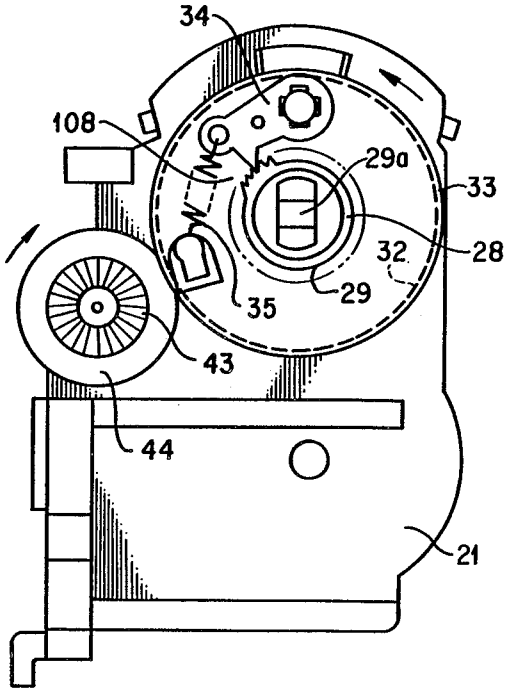
FIG. 6 is a partially enlarged bottom view of the mechanism shown in FIG. 5.
Figure 5:
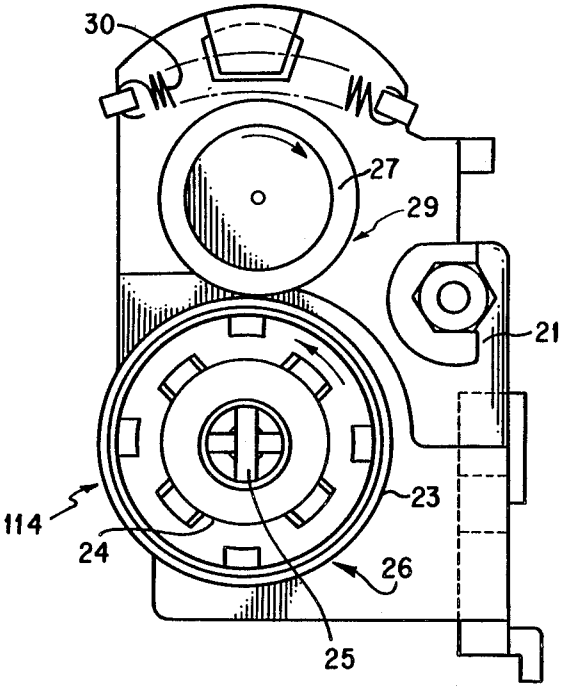
FIG. 5 is a partially enlarged plan view of a ribbon winding mechanism.

When the intermediate gear 32 and the disc 33 are rotated together in the counter-clockwise direction in FIG. 6, the rotation transmitting element 29 is rotated in the clockwise direction in FIG. 5 due to engagement between the pawl 34 and the ratchet wheel 28 against the rotational resistance exerted by the spring 30. Thus, the ribbon take-up unit 26 is rotated in the counter-clockwise direction (=in a take-up direction) in FIG. 5 due to engagement between the intermediate gear 27 and the transmission gear 23.

When the disc 33 is rotated in the clockwise direction in FIG. 6, the pawl 34 is swung back and forth while riding over the teeth of the ratchet wheel 28 against the biasing force of the spring 35. Thus, the rotation transmitting element 29 is kept being held against rotation due to the spring 30, so that the ribbon take-up unit 26 is also kept being held against rotation.

As shown in FIGS. 2, 3 and FIGS. 8A through 8D, an intermittent driven gear 41 is further mounted on the pivot stud 72 at a location between the intermediate drive gear 12 and the disc 33. The intermittent gear 41 is formed with a threaded section 41*a* which extends through a certain angular range to come into mesh with the threaded section 12*a* of the intermittent drive gear 12, and arc-shaped dents 41*b* and 41*c* which are on either side of the threaded section 41*a*. The threaded section 41*a* is engageable with the threaded section 12*a* of the intermittent drive gear 12. The arc-shaped dents 41*b* and 41*c* have the radius of curvature equal to that of the plane section 12*b* to be contactable therewith. The remaining portion 41*d* of the circumferential surface, of the intermittent gear 41 is formed to have a smaller diameter than that of the plain portion 12*b* of the intermediate drive gear 12.

Figure 2:
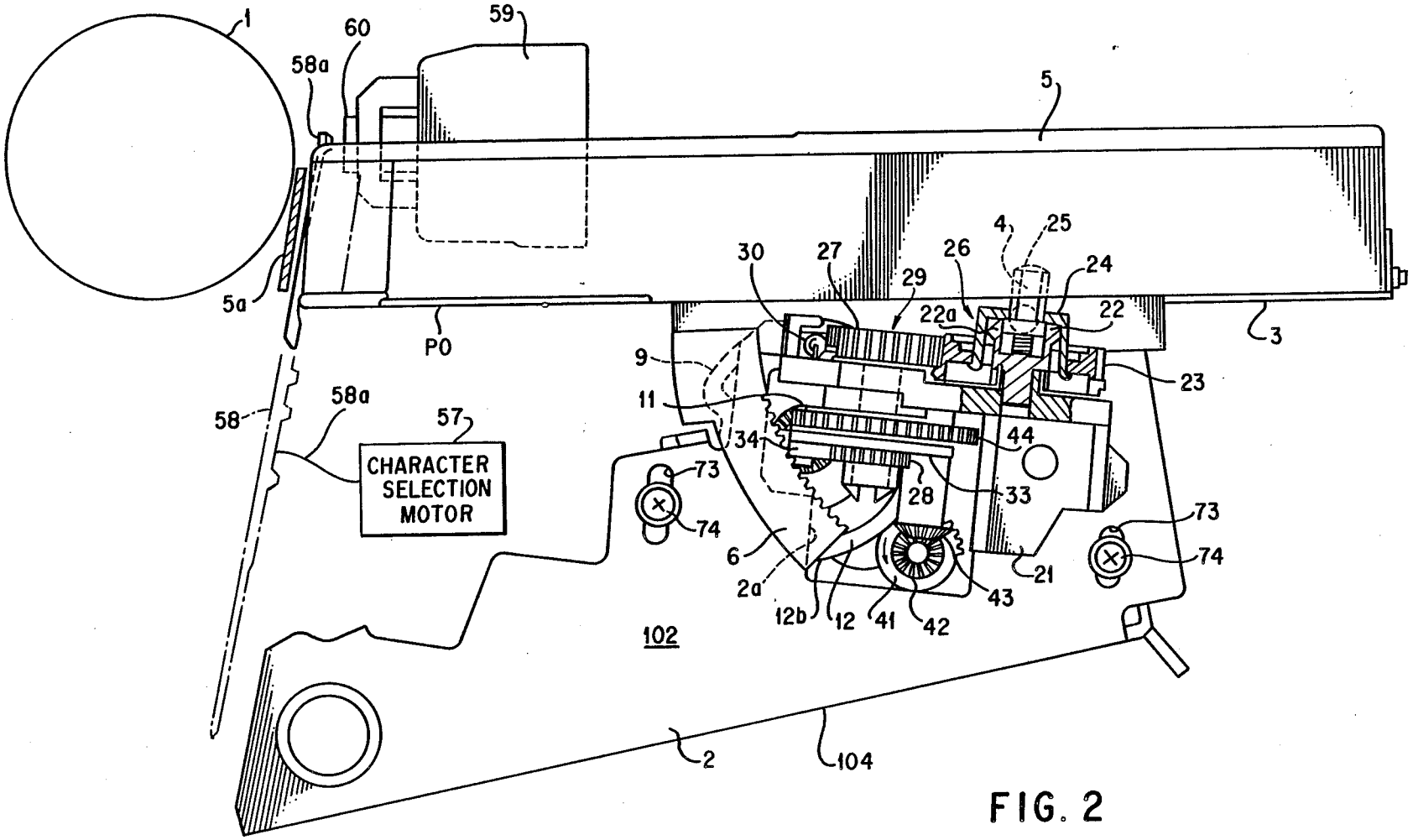
FIG. 2 is a partial elevation showing a ribbon holder and related parts of the typewriter shown in FIG. 1.

As shown in FIG. 2, the intermittent driven gear 41 is integrally provided with a bevel gear 42. Accordingly, rotation of the intermittent driven gear 41 is transmitted to the intermediate gear 32 and the disc 33 by way of another bevel gear 43 mounted on the bracket 21 which is in mesh with the bevel gear 42 and a small-diameter intermediate gear 44.

Figure 9:
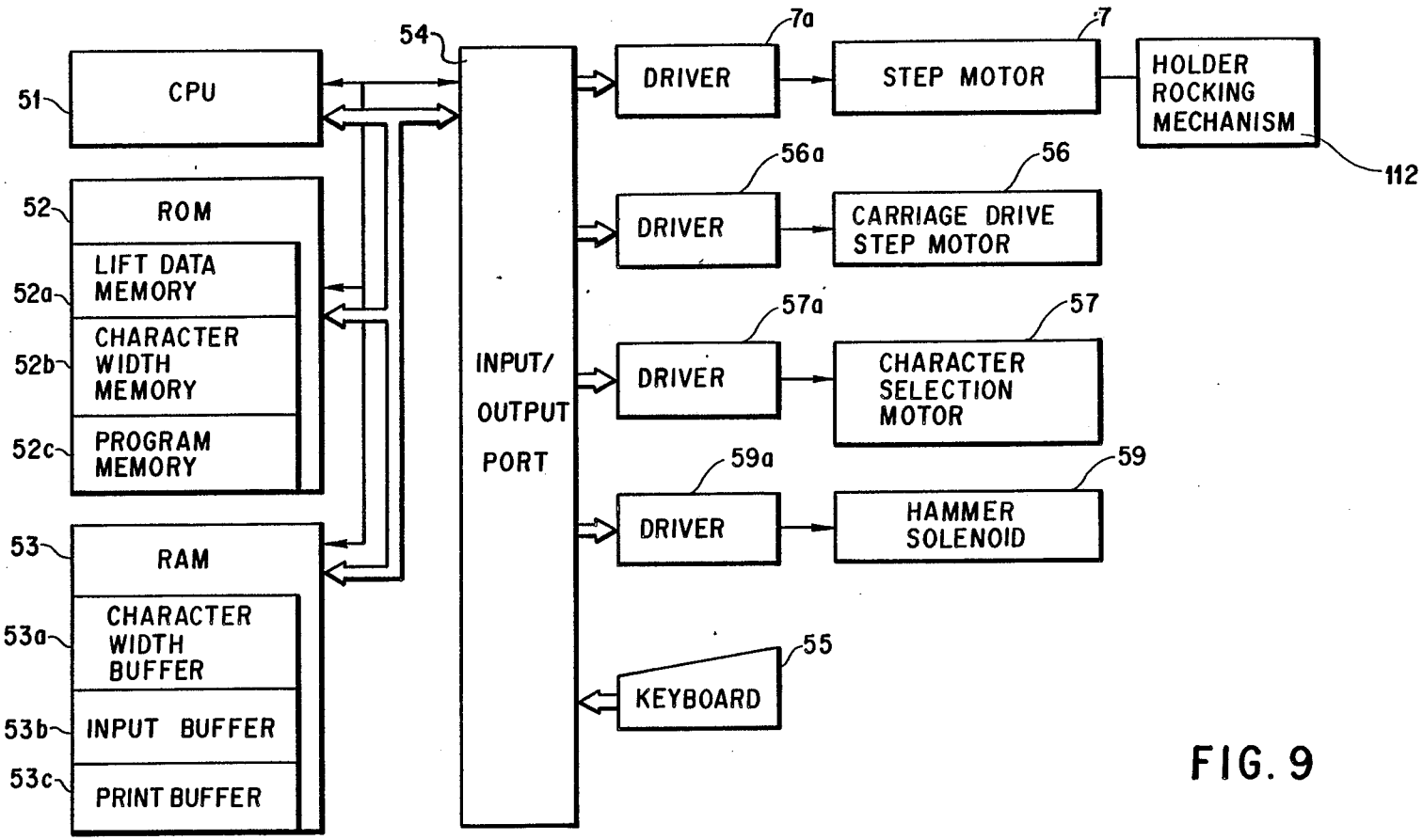
FIG. 9 is a block diagram showing an electric control system of the typewriter shown in FIG. 1.

FIG. 9 is a block diagram showing a control system of the typewriter, which principally comprises a CPU (central processing unit) 51, a ROM (read only memory) 52, a RAM (randam access memory) 53 and an input/output port 54.

Figure 11A:
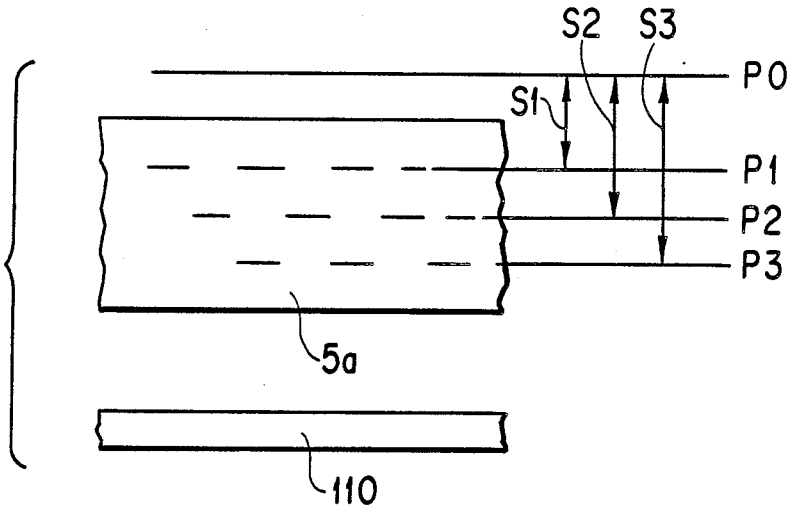
FIGS. 11A and 11B are explanatory views showing the lift positions of the print ribbons.
Figure 11B:
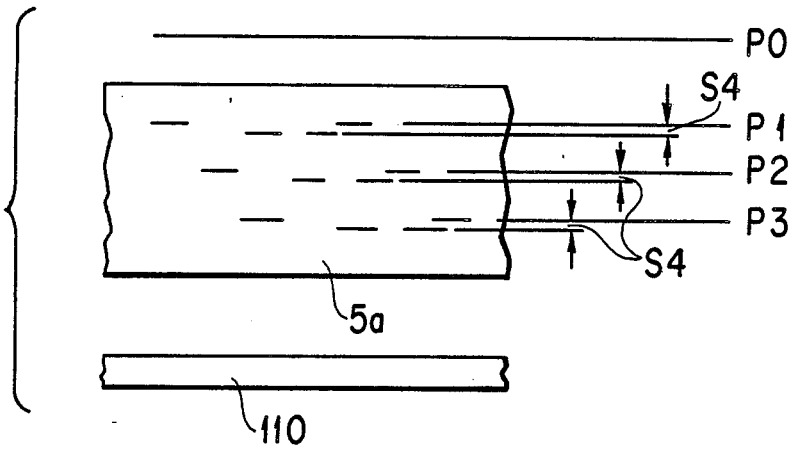

The ROM 52 comprises a program memory 52*c* having stored therein control programs for the typewriter. The ROM 52 further comprises a lift data memory 52*a* having stored therein the data representing the moving strokes S1 to S3 of the step motor 7 (=lift stroke data) for lifting the ribbon holder 3 from the home position P0 to the lift positions P1 to P3 shown in FIG. 11A as well as the data of an additional moving stroke S4 (=lift stroke data) to be added to the strokes S1 to S3 when printing certain wider characters and symbols such as underlines.

Also included in the ROM 52 is a character width data memory 52*b* for storing widths of characters and symbols corresponding to the data inputted through a keyboard 55.

As the driving power source is shared by the holder rocking mechanism 112 and the ribbon winding mechanism 114 in this embodiment, the moving stroke data S1 to S4 mentioned above are the ribbon take-up volume data as well.

The RAM 53 includes a character width buffer 53*a* which temporarily stores the widths of previously printed characters or symbols up to the third one from the current print position, an input buffer 53*b* storing and sequentially updating the data entered through the keyboard 55, and a print buffer 53*c* to write in the data related to printing operation out of the data written in the input buffer 53*b*.

The CPU 51 drives a carriage drive step motor 56 via the input/output port 54 and a driver 56*a* in accordance with the control program to cause the carriage 2 to travel along the platen 1. The CPU 51 also drives a character selection motor 57 on the carriage 2 via the input/output port 54 and a driver 57*a*. A character wheel 58 mounted on an output shaft 58*a* of the character selection motor 57 is then turned to place a selected type element 58*a* in opposition to the platen 1.

Furthermore, the CPU 51 feeds a drive signal to a hammer solenoid 59 on the carriage 2 shown in FIG. 1 via the input/output port 54 and the driver 59*a* to cause a print hammer 60 to strike the selected type element 58*a* against the platen 1. The CPU 51 also feeds a drive signal to the step motor 7 via the input/output port 54 and the driver 7*a* to control the operations of the holder rocking mechanism 112 and the ribbon winding mechanism 114 in response to rotation of the motor 7.

Operation of the typewriter arranged as above is now described in particular details for the ribbon lift and ribbon winding mechanism 112, 114.

Figure 8A:
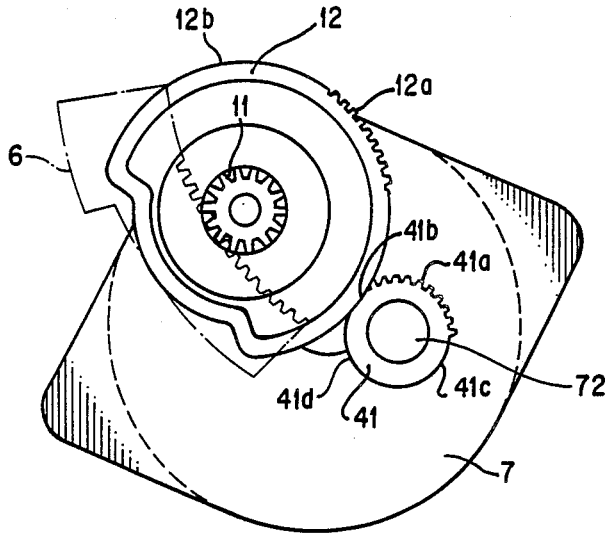
FIGS. 8A through 8D are explanatory views for operation of an intermittent gear train.
Figure 8B:
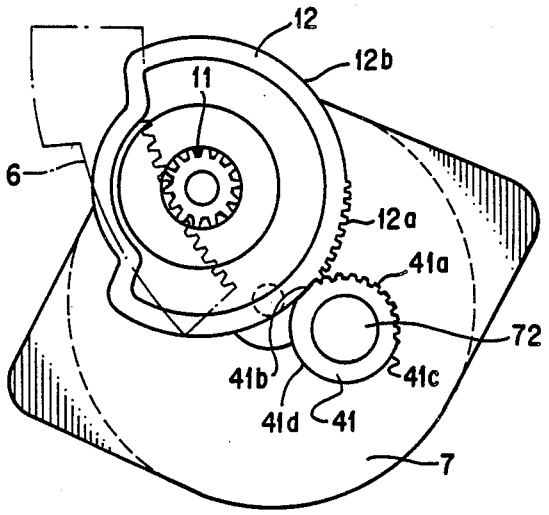

In FIG. 2, the ribbon cassette 5 is located at its home position P0 and the transmission gear 6 of the holder 3 is in engagement with the small-diameter intermediate gear 11 of the rotary element 9. In this position, as illustrated in FIG. 8A, one arc-shaped dent 41*b* of the intermittent driven gear 41 is in engagement with the plain section 12*b* of the gear 12. When the character keys 106 on the keyboard 55 are operated at a certain typing speed (relatively low speed), the CPU 51 drives the step motor 7 in accordance with the lift stroke data and the character width data both stored within the ROM 52.

FIG. 10, shows a flow chart of a program stored in the ROM 52 to be executed when manual typing is carried out. In this program, the CPU 51 discriminates in step S70 whether or not the key operated earlier is the large width character key 55*a*. If so the step goes to step S71 to discriminate whether or not the key operated is the underline key 55*b*. If so, the step goes to step S72 to discriminate whether or not the third printed character back from the current position is an underline. If the answer is YES, the step goes to step S73 to discriminate whether or not the underline has been printed at a position higher than a standard lift position. If the answer is NO, the CPU 51 in step S74 reads the fourth lift data S3 from the ROM 52.

The CPU 51 subsequently discriminates in steps S75 and S76 which lift position the previous print operation has taken place, i.e., which print zone of the print ribbon 5*a* has been used. In dependence on the discrimination result, the CPU 51 reads any of the lift stroke data S1 to S3 from the ROM 52 (steps S77, S78 and S79). The next step S80 provides a total lift stroke St ($St=Sn+S4$, n=1 through 3), in accordance with which the step motor 7 is driven (step S81).

If, on the other hand, step S70 gives the answer NO, the step goes to step S75. Further if either one of steps S71 and S72 gives the answer NO, or if step S73 gives YES, the processing at step S74 does not take place, going to step S75.

When the total lift stroke is set at the first lift stroke S1 in the processing above, the step motor 7 causes the intermittent drive gear 12 to be rotated in the clockwise direction from the position shown in FIG. 8A to the position shown 8B. Accordingly, the ribbon cassette 5 as well as the ribbon holder 3 are lifted from the home position P0 shown in FIG. 7 to the first lift position P1 against the biasing force of the tension spring 75. Here, the plain section 12*b* of the intermittent drive gear 12 only moves along one dent 41*b* of the intermittent driven gear 41, so that no rotational movement is transmitted to the intermittent driven gear 41, with no ribbon take-up operation taking place. Vibration that may occur when stopping the rocking motion of the ribbon holder 3 is absorbed by the tension spring 75.

When the print operation is completed, the step motor 7 is reversely driven for the amount corresponding to the first lift stroke S1 to return the ribbon holder 3, i.e., the ribbon cassette 5 to the home position P0.

Figure 8C:
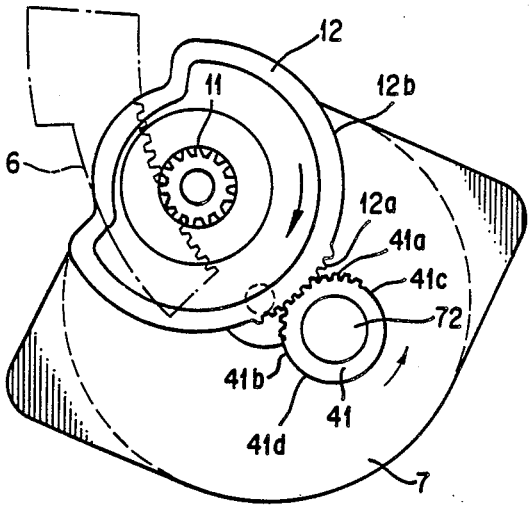

When the total lift stroke St is set to be the second lift stroke S2, the step motor 7 causes the intermittent drive gear 12 to be rotated in the clockwise direction from the position shown in FIG. 8A to the position shown in FIG. 8C. Accordingly, the ribbon cassette 5 is lifted from the home position P0 to the second lift position P2. Here, the threaded section 12*a* of the intermittent drive gear 12 is brought into mesh with the threaded section 41*a* of the intermittent driven gear 41 so that the intermittent driven gear 41 is rotated in the clockwise direction in FIGS. 2, 3 and 8A through 8D.

This rotation of the intermittent driven gear 41 is transmitted to the disc 33 via the bevel gears 42 and 43, the small-diameter intermediate gear 44 and the intermediate gear 32 so that the disc 33 is rotated in the counter-clockwise direction in FIG. 6. Thereby, the rotation transmitting element 29 is rotated in the clockwise direction in FIG. 5 by engagement between the ratchet 34 and the ratchet wheel 28. Accordingly, the ribbon take-up unit 26 is rotated in the counter-clockwise direction in FIG. 5 to take up the used section of the print ribbon 5*a* onto a take-up spool (not shown).

When the print operation is completed, the step motor 7 is reversely driven for the amount corresponding to the second lift stroke S2 to return the ribbon cassette 5 to the home position P0. Here, the intermittent drive gear 12 is rotated in the counter-clockwise direction in FIG. 8C, so that the intermittent driven gear 42 is rotated in the clockwise direction. This rotational movement is not transmitted to the ribbon take-up unit 26 by the ratchet mechanism 108 provided between the disc 33 and the ribbon take-up unit 26. This means that taking up the print ribbon 5*a* does not take place when returning the ribbon cassette 5 to the home position P0.

When the total lift stroke St is set to be the third lift stroke S3, the step motor 7 causes the intermittent drive gear 12 to be rotated in the clockwise direction from the position shown in FIG. 8A across the position shown in FIG. 8C until the threaded section 12*a* of the intermittent drive gear 12 is about to be disengaged from the threaded section 41*a* of the intermediate driven gear 41. With this rotational movement, the ribbon cassette 5 is lifted from the home position P0 to the third lift position P3. Rotation of the intermittent driven gear 41 also causes the ribbon take-up unit 26 to take up the used section of the print ribbon 5*a* in the same manner as described.

When the total lift stroke St is set at the sum of lift strokes S1, S2 or S3 and the fourth lift stroke S4 to print a character or a symbol with a greater width, it would be readily understood from the above description that the step motor 7 is rotated by an extra stroke of S4 when lifting the ribbon cassette 5 to the lift position P1, P2 or P3.

Accordingly, the ribbon cassette 5 is lifted to a position slightly higher than the lift position P1, P2 or P3 to perform printing at this position, while an extra amount of the print ribbon 5*a* is taken up when lifting to the second lift position P2 or the third lift position P3. As a result, a character with a greater width does not overlap, to thereby ensure a proper printing operation in dependence on the dimension of the print element 58*a*.

Figure 8D:
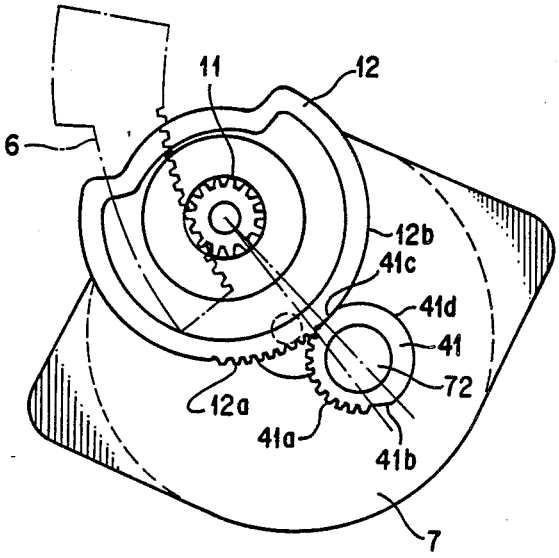

Only when the ribbon cassette 5 is lifted to the third lift position P3 with an extra lift to print a character or a symbol with a greater width, the threaded section 12*a* of the intermittent drive gear 12 finally goes out of engagement with the threaded section 41*a* of the intermittent driven gear 41, as shown in FIG. 8D. The plain section 12*b* is thus brought into engagement with the other dent 41*c* of the intermittent driven gear 41.

This means that, when printing most characters and symbols with regular width, the threaded section 12*a* of the intermittent drive gear 12 is never out of engagement with the threaded section 41*a* of the intermittent driven gear 41 because of lifting to the third lift position P3. This will prevent misengagement of the gear 12 when it is rotated in reverse to return to the home position P0, ensuring an enhanced reliability in operation.

Figure 10A:
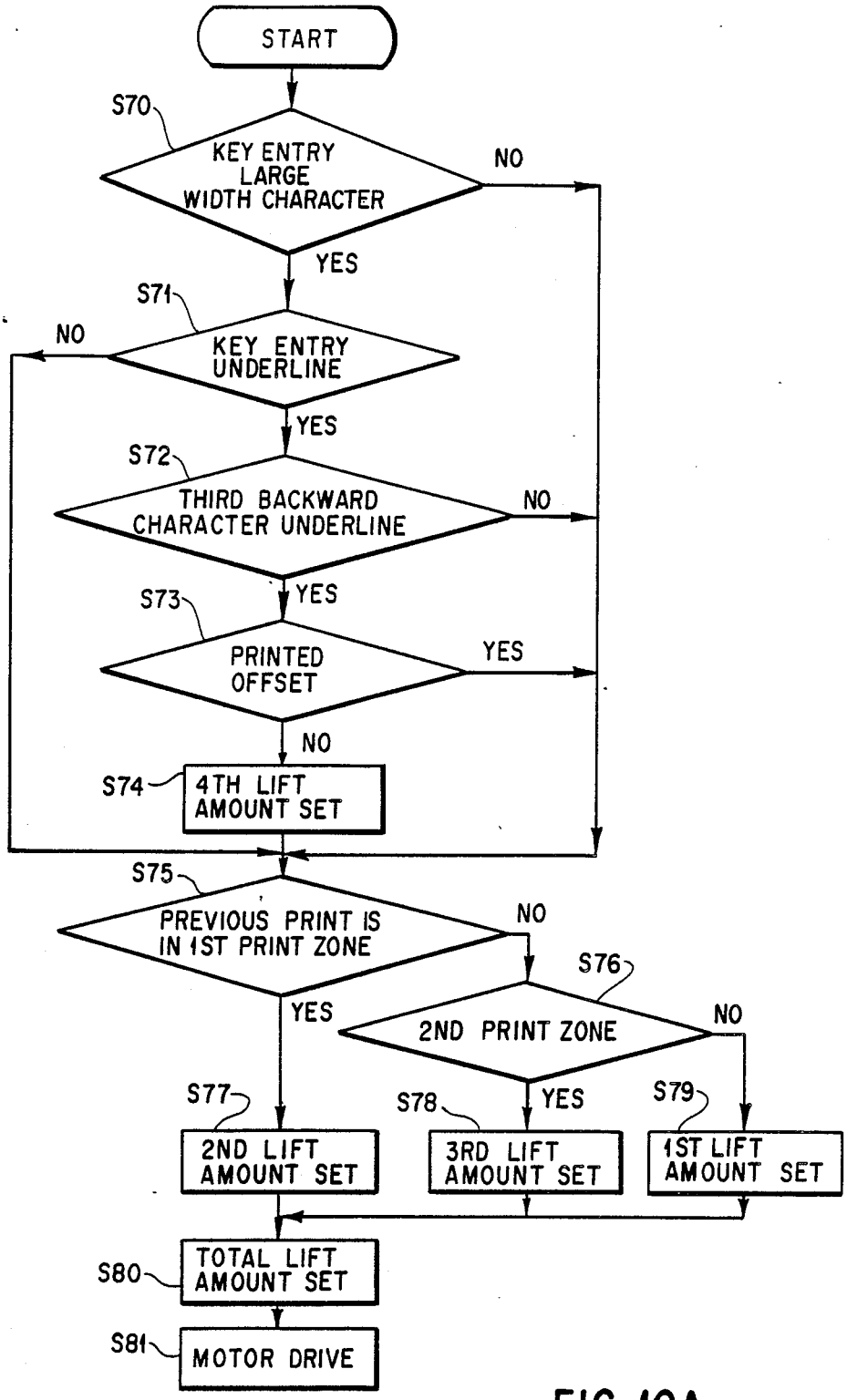
FIGS. 10A and 10B are flow charts of the program executed by the electric control system shown in FIG. 9.
Figure 10B:
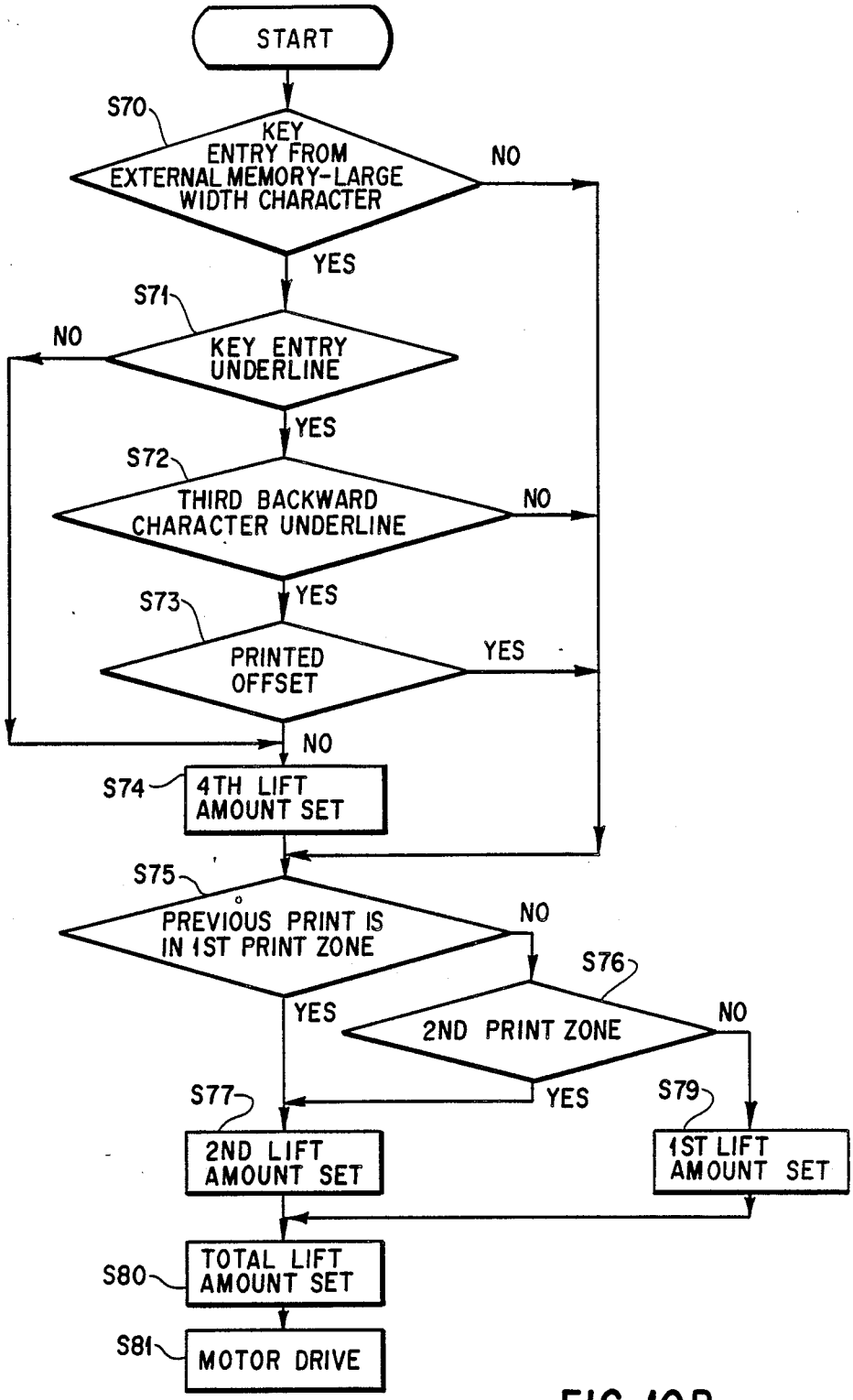

FIG. 10B shows a flow chart of another program stored in the ROM 52 to be executed when automatic typing is carried out based upon the text data stored, for instance in an external memory device, not shown. This program is different from the program of FIG. 10A in that the step S78 is omitted and the second lift amount is set in case the result of the step S76 is YES.

That is, it is necessary to return the ribbon holder 3 to the home position P0 per one character typing for allowing an operator to check whether the typed character is the correct one or not in manual typing operation. However, in case of automatic typing it is unnecessary to check the typed character and therefore unnecessary to return the ribbon holder 3 to the home position P0 per one character typing.

Thus, the step S78 in the program of FIG. 10A is replaced by the step 77 in the program of FIG. 10B.

In the above embodiment, since rotation of the pulse motor 7 as a drive power source is transmitted to the ribbon take-up unit 28 by means of the intermittent gears 12 and 41, the load to be applied to the drive power source due to the arrangement of the power transmission is minimized to enable using a less expensive pulse motor with a smaller torque.

For correcting a printed character in the typewriter in this embodiment, the ribbon holder 3 is lifted slightly above the third lift position P3, while a correction ribbon 110 located below the print ribbon 5*a* is placed in opposition to the platen 1. The intermittent drive gear 12 is further rotated in the clockwise direction in FIG. 8D from the position shown in the drawing. In this case, the plain section 12*b* of the intermittent drive gear 12 only moves along the other dent 41*c* of the intermittent driven gear 41, with no operation of the ribbon winding mechanism taking place.

Figure 12:
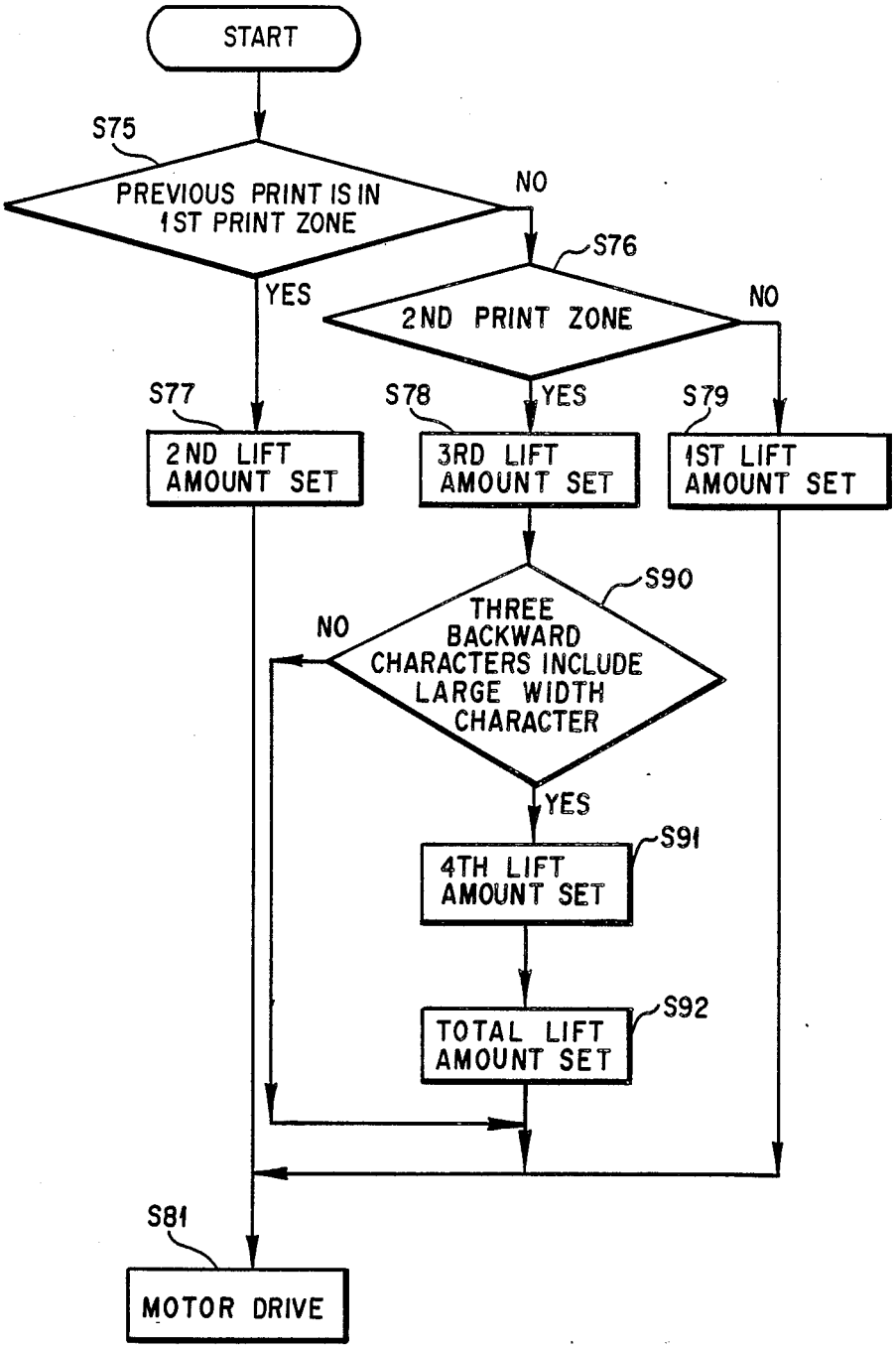
FIG. 12 is a flow chart of the modified program executed by the electric control system shown in FIG. 9.

FIG. 12 shows a flow chart of a modified operation program for the typewriter described above to be adopted instead of the programs of FIGS. 10A and 10B.

In this modification, although not illustrated in the drawings, the range of the threaded section 12a of the intermittent drive gear 12 and that of the threaded section 41*a* of the intermittent drive gear 41 are shifted to come into mesh with each other only when the third lift amount is set. That is the ribbon 5*a* is taken up at a predetermined amount only when the ribbon holder 3 is rocked up to its third lift position P3.

Further, the forth lift amount S4 is set at step S91 and the total lift amount is set at step S92 only when at least one of three backward characters is the large width character, which is discriminated at step S90.

Obviously, the invention is not limited to the foregoing embodiments, but the structural arrangement of the invention can be modified as desired without departing from the subject matter of the invention, for instance, by using an electromagnetic solenoid as a drive power source, using some power transmission mechanism other than the ratchet and ratchet wheel, and carrying out ribbon take-up operation when returning the ribbon cassette 5 to the home position P0.

What is claimed is:

1. A printing apparatus employing a print ribbon mounted on a ribbon holder, said print ribbon being provided with at least two print zones divided in width direction thereof, said print zones being cyclically located opposedly to a print position on a platen, said printing apparatus comprising:

a drive power source;

a holder rocking mechanism for rocking said ribbon holder about a pivot shaft extending in parallel with said platen to cyclically locate said print zones opposedly to said print position wherein said holder rocking mechanism comprises a driving means rotated by said drive power source and driven means extending along an arc around said pivot shaft to be meshed with said driving means, one end of said driven means being secured to said ribbon holder, whereby said driven means is reciprocally moved along said arc and said ribbon holder is reciprocally rocked about said pivot shaft;

a ribbon winding mechanism for winding a used section of the print ribbon; and an intermittent gear train for transmitting the driving force of said drive power source to said ribbon winding mechanism simultaneously with a shifting of the print zones opposed to said print position by a predetermined rocking motion of said ribbon holder.

2. The printing apparatus according to claim 1 which further comprises:

a carriage shiftable parallel to said platen, said pivot shaft being secured to said carriage;

a bracket mounted on said carriage for relative rotation of said bracket with respect to said carriage in a predetermined range, said drive power source and said driving means being supported by said bracket; and fixing means for fixing said bracket to said carriage in an adjusted positional relation;

whereby said driven means and said driving means being disengaged or reengaged by rotating said bracket with respect to said carriage by loosening said fixing means.

3. The printing apparatus according to claim 1 wherein said intermittent gear train comprises:

a first gear wheel disposed coaxially with said driving means to be rotated by said drive power source, said first gear wheel being provided with a threaded portion in a predetermined range and a pair of plain portions disposed on either side of said threaded portion on the circumferential peripheral surface thereof; and a second gear wheel provided with a threaded portion in a predetermined range on the circumferential peripheral surface thereof to be meshed with said threaded portion of the first gear wheel, said second gear wheel being further provided on the circumferential surface thereof with a pair of arc-shaped dents respectively in a predetermined range disposed on either side of said plain portions to slidably contact said plain portions of the first gear wheel, the remaining portion of the circumferential peripheral surface of said second gear wheel having larger diameter than that of said plain portions of the first gear wheel, whereby the driving force of said drive power source being transmitted to said second gear wheel only in a predetermined stroke of rotation of said first gear wheel.

4. The printing apparatus according to claim 3 wherein said intermittent gear train further comprises:

a rotary shaft;

a intermediate gear wheel secured to one end of said rotary shaft;

resistance exerting means for exerting a rotational resistance against said intermediate gear wheel;

a ratchet wheel secured to the other end of said rotary shaft coaxially with said intermediate gear wheel;

a disc member disposed coaxially with and relatively rotatably to said ratchet wheel, said disc member being reciprocally rotated upon rotation of said second gear wheel;

a ratchet pawl swingably mounted on said disc member to be engaged with said ratchet wheel; and biasing means for biasing said ratchet pawl to swing in a direction to be engaged with said ratchet wheel;

and wherein said ratchet pawl is engaged with said ratchet wheel in such a manner that when said disc member is rotated in a predetermined direction, said ratchet wheel is rotated together with said disc member against the rotational resistance exerted by said resistance exerting means, while said ratchet pawl being swung against the biasing force of said biasing means and said ratchet wheel does not rotate with said disc member due to the rotational resistance when said disc member is rotated in reverse direction, whereby said intermediate gear wheel is rotated only when said second gear wheel is rotated in the predetermined direction.

5. The printing apparatus according to claim 4 wherein said resistance exerting means comprises a coil spring arranged to contact the circumferential peripheral surface of said intermediate gear wheel.

6. The printing apparatus according to claim 4 wherein said ribbon winding mechanism comprises:

a spool shaft;

a rotatable supporting member supporting said spool shaft on the rotary axis thereof in such a manner that said spool shaft is allowed to be tilted about said rotary axis but prevented from relative rotation with respect to said supporting member; and a gear ring coaxially secured to said rotatable supporting member, said gear ring being meshed with said intermediate gear wheel, whereby said spool shaft being rotated only in said predetermined direction and in said predetermined stroke of rotation of said first gear wheel.

7. A printing apparatus employing a print ribbon mounted on a ribbon holder, said print ribbon being provided with at least two print zones divided in width direction thereof, said print zones being cyclically located opposedly to a print position on a platen, said printing apparatus comprises:

a holder rocking mechanism for rocking said ribbon holder to cyclically locate said print zones opposedly to said print position;

a drive power source for driving said holder rocking mechanism;

a ribbon winding mechanism for winding a used section of the print ribbon;

power transmitting means for transmitting the driving force of said drive power source to said ribbon winding mechanism simultaneously with a shifting of the print zones opposed to said print position by a predetermined rocking motion of said ribbon holder;

first setting means for setting a stroke of rocking motion of said ribbon holder in accordance with a ribbon winding volume depending upon a size of a character or symbol to be printed;

discriminating means for discriminating one of the print zones to be used for next printing based upon the previously used print zone;

second setting means for setting a stroke of rocking motion of said ribbon holder in accordance with the print zone discriminated by said discriminating means; and control means for driving said drive power source in accordance with the total amount of rocking motion strokes being set by said first and second setting means.

8. The printing apparatus according to claim 7 wherein said first setting means includes:

first memory means having stored therein data relating to an additional stroke of rocking motion of said ribbon holder corresponding to large width's characters and symbols;

first judging means for judging whether a character or symbol to be printed is a large width character or symbol;

second memory means for saving width data of character or symbol previously printed on the print zone to be used in next printing; and third memory means for saving the stroke of rocking motion of said ribbon holder on printing said character or symbol previously printed on the print zone to be used in next printing;

whereby said first setting means sets said additional stroke only when the character or symbol to be next printed is the large width character or symbol and the large width character or symbol is printed in the previous printing on the print zone to be used on next printing.

9. The printing apparatus according to claim 8 which further comprises:

second judging means for judging whether the previous printing on the print zone to be used on next printing is carried out by adding said additional stroke set by the first setting means to the stroke set by said second setting means, whereby said first setting means sets said additional stroke only when the character or symbol to be next printed is the large width's character or symbol and the large width's character or symbol is printed in the previous printing on the print zone to be used on next printing without setting said additional stroke.

10. The printing apparatus according to claim 7 wherein said second setting means includes memory means having stored therein data relating to a stroke of rocking motion of said ribbon holder corresponding to each of said print zones.

11. The printing apparatus according to claim 1 which further comprises:

first discriminating means for discriminating one of the print zones to be used for next printing based upon the previously used print zone;

first setting means for setting a stroke of rocking motion of said ribbon holder in accordance with the print zone discriminated by said discriminating means;

second discriminating means for discriminating whether or not at least one large width character is printed in a previous cycle of printing with said print zones, said discrimination being executed only when the predetermined print zone is discriminated as the next print zone by said first discriminating means;

second setting means for setting an additional stroke of rocking motion of said ribbon holder when the result of discrimination by said second discrimination is affirmative; and control means for driving said drive power source in accordance with the total amount of rocking motion strokes being set by said first and second setting means.

12. A printing apparatus employing a print ribbon mounted on a ribbon holder, said print ribbon being provided with at least two print zones divided in width direction thereof, said print zones being cyclically located opposedly to a print position on a platen, said printing apparatus comprising:

a drive power source;

a holder rocking mechanism for rocking said ribbon holder about a pivot shaft extending in parallel with said platen to cyclically locate said print zones opposedly to said print position wherein said holder rocking mechanism comprises a driving means rotated by said drive power source and driven means extending along an arc around said pivot shaft to be meshed with said driving means, one end of said driven means being secured to said ribbon holder, whereby said driven means is reciprocally moved along said arc and said ribbon holder is reciprocally rocked about said pivot shaft;

a ribbon winding mechanism for winding a used section of the print ribbon;

an intermittent gear train for transmitting the driving force of said drive power source to said ribbon winding mechanism simultaneously with a shifting of the print zones opposed to said print position by a predetermined rocking motion of said ribbon holder;

first discriminating means for discriminating one of the print zones to be used for next printing based upon the previously used print zone;

first setting means for setting a stroke of rocking motion of said ribbon holder in accordance with the print zone discriminated by said discriminating means;

second discriminating means for discriminating whether or not at least one large width character is printed in a previous cycle of printing with said print zones, said discrimination being executed only when the predetermined print zone is discriminated as the next print zone by said first discriminating means;

second setting means for setting an additional stroke of rocking motion of said ribbon holder when the result of discrimination by said second discrimination is affirmative; and, control means for driving said drive power source in accordance with the total amount of rocking motion strokes being set by said first and second setting means.

* * * * *